US008521068B2

(12) United States Patent
Oda

(10) Patent No.: US 8,521,068 B2
(45) Date of Patent: Aug. 27, 2013

(54) IMAGE FORMING APPARATUS USING LIQUID DEVELOPER

(75) Inventor: Tomoyuki Oda, Osaka (JP)

(73) Assignee: Kyocera Mita Corporation (JP)

( * ) Notice: Subject to any disclaimer, the term of this patent is extended or adjusted under 35 U.S.C. 154(b) by 305 days.

(21) Appl. No.: 13/023,760

(22) Filed: Feb. 9, 2011

(65) Prior Publication Data

US 2011/0206417 A1 Aug. 25, 2011

(30) Foreign Application Priority Data

Feb. 19, 2010 (JP) ..... 2010-034401

(51) Int. Cl.
*G03G 15/10* (2006.01)

(52) U.S. Cl.
USPC ..... 399/238; 399/237

(58) Field of Classification Search
USPC ..... 399/237, 238, 239, 249
See application file for complete search history.

(56) References Cited

U.S. PATENT DOCUMENTS

| | | | | |
|---|---|---|---|---|
| 4,860,050 | A | 8/1989 | Kurotori et al. | |
| 7,158,741 | B2 * | 1/2007 | Kim et al. | 399/237 |
| 2005/0053398 | A1 | 3/2005 | Kim et al. | |
| 2008/0181671 | A1 | 7/2008 | Oda | |
| 2008/0205935 | A1 | 8/2008 | Oda | |

FOREIGN PATENT DOCUMENTS

| | | |
|---|---|---|
| JP | 2001125383 | 5/2001 |
| JP | 2006-267354 | 10/2006 |

* cited by examiner

*Primary Examiner* — Hoang Ngo
(74) *Attorney, Agent, or Firm* — Gerald E. Hespos; Michael J. Porco; Matthew T. Hespos

(57) ABSTRACT

An image forming apparatus includes a developing device, a liquid developer supplying device including a liquid developer flow path and supplying a liquid developer containing a solid content to the developing device through a discharge port of the liquid developer flow path, a storage container storing the liquid developer, a conveying mechanism capable of feeding the liquid developer from the storage container to the liquid developer flow path and feeding the liquid developer in the liquid developer flow path back to the storage container and a controller controlling the conveying mechanism. At the time of non-developing operation in which a toner image forming operation is not performed by the developing device, the controller controls the conveying mechanism to feed at least a part of the liquid developer present in the liquid developer flow path back to the storage container.

10 Claims, 10 Drawing Sheets

IMAGE FORMING APPARATUS USING LIQUID DEVELOPER

BACKGROUND OF THE INVENTION

1. Field of the Invention

The present invention relates to a wet-type image forming apparatus for forming a toner image using a liquid developer.

2. Description of the Related Art

There is known a wet-type image forming apparatus for forming a toner image using a liquid developer. The wet-type image forming apparatus includes an image carrying member on which a toner image is to be formed, a developing device for supplying a liquid developer to the image carrying member to form a toner image on the image carrying member, a liquid developer supplying device for supplying the liquid developer to the developing device, a transfer unit for transferring the toner image on the image carrying member onto a sheet, and a fixing unit for fixing the toner image on the sheet to the sheet.

The liquid developer has a high viscosity since toner as a solid content is dispersed in a dielectric liquid as a carrier. To obtain a high-quality toner image using a liquid developer having a high viscosity, the liquid developer supplying device needs to form a liquid developer layer with a uniform thickness on the circumferential surface of a developing roller when supplying the liquid developer to the developing roller of the developing device.

The following related art is known as a technology meeting such a request. In this related art, a liquid developer supplying device used in a wet-type image forming apparatus is such that two discharge ports are arranged side by side in a circumferential direction of a developing roller and are slits extending in an axial direction of the developing roller, and a liquid developer is discharged onto the circumferential surface of the developing roller via these discharge ports to form a liquid developer layer with a uniform thickness on the circumferential surface.

However, in the image forming apparatus of the related art, the liquid developer may leak from the discharge ports of the liquid developer supplying device due to an impact or vibration produced when the developing device is detached from an apparatus main body of the image forming apparatus, for example, for maintenance of the developing device. If the liquid developer leaks to the outside, the interior of the apparatus main body is contaminated. If the running down or dripping liquid developer adheres to the hand of a maintenance operator, a maintenance operation is disrupted.

If a developing operation is not performed for a long time, the toner as the solid content in the liquid developer settles down in the liquid developer supplying device. Thus, when a new developing operation is performed, inconveniences such as a reduction in toner supply amount and a discharge failure are likely to occur. This makes it difficult to form a liquid developer layer with a uniform thickness on the circumferential surface of the developing roller.

SUMMARY OF THE INVENTION

Accordingly, an object of the present invention is to provide an image forming apparatus capable of suppressing leakage of a liquid developer to the outside and suppressing the precipitation of the liquid developer.

In order to accomplish the above object, one aspect of the present invention is directed to an image forming apparatus including an image carrying member on which a toner image is to be formed, a developing device supplying a liquid developer containing a solid content to the image carrying member to form the toner image on the image carrying member, a liquid developer supplying device including a liquid developer flow path in which the liquid developer flows and supplying the liquid developer to the developing device through a discharge port of the liquid developer flow path, a storage container storing the liquid developer, a conveying mechanism capable of feeding the liquid developer from the storage container to the liquid developer flow path and feeding the liquid developer in the liquid developer flow path back to the storage container and a controller controlling the conveying mechanism. At the time of non-developing operation in which a toner image forming operation is not performed by the developing device, the controller controls the conveying mechanism to feed at least a part of the liquid developer present in the liquid developer flow path back to the storage container.

Other objects of the present invention and specific advantages obtained by the present invention will become more apparent from the description of embodiment below.

DETAILED DESCRIPTION OF THE PREFERRED EMBODIMENTS

Hereinafter, one embodiment of the present invention is described with reference to the drawings.

Figure 1:
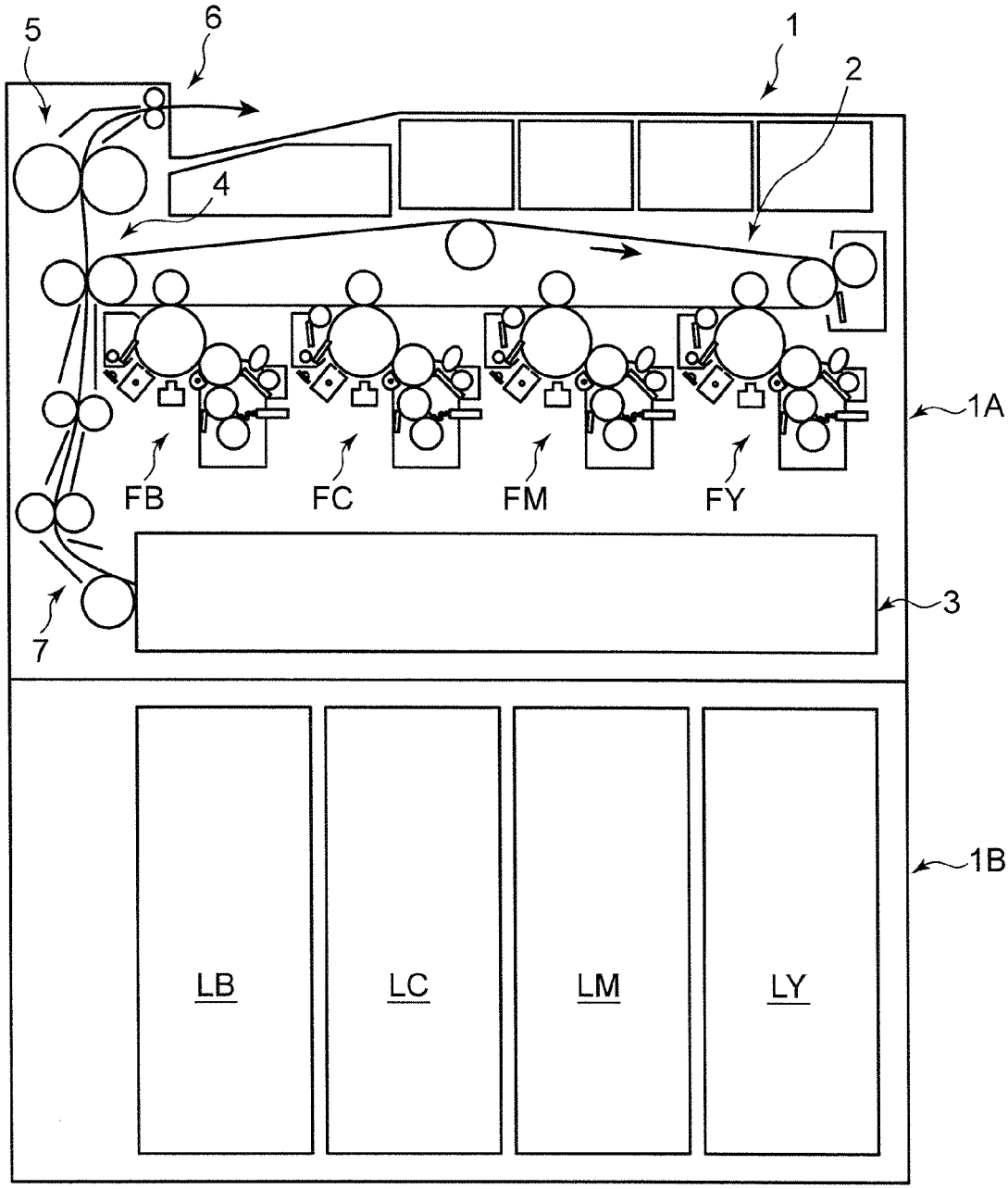
FIG. 1 is a schematic construction diagram of a wet-type image forming apparatus according to one embodiment of the invention.
Figure 2:
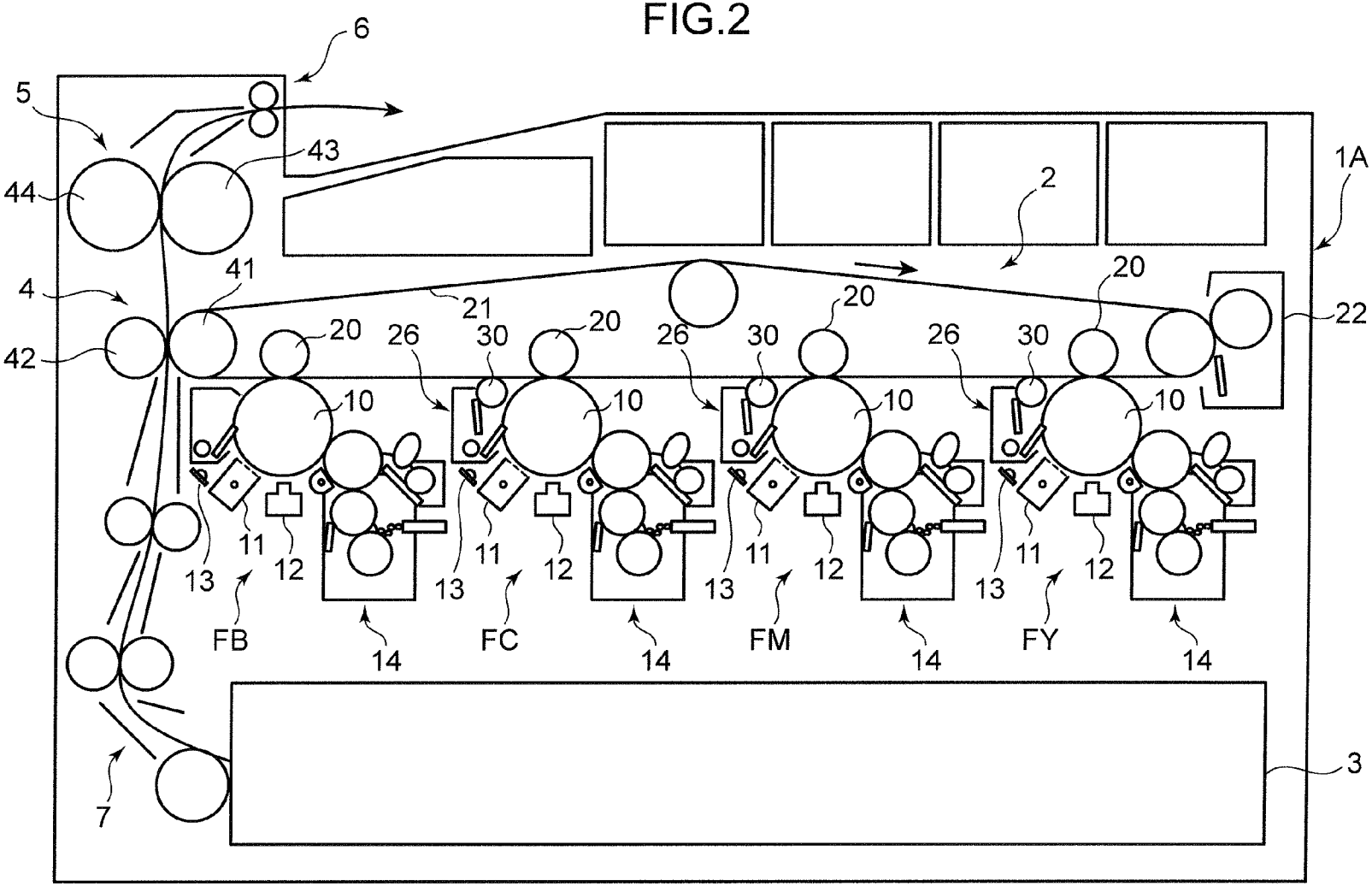
FIG. 2 is a schematic sectional view of the wet-type image forming apparatus excluding liquid developer circulation devices according to the embodiment of the invention.

FIG. 1 is a schematic construction diagram of a wet-type image forming apparatus according to the embodiment of the invention, and FIG. 2 is a schematic sectional view of the wet-type image forming apparatus excluding liquid developer circulation devices according to the embodiment of the invention. Although the image forming apparatus 1 shown in FIGS. 1 and 2 is a color printer, it may be another apparatus capable of forming an image on a sheet such as a copier, a facsimile machine or a complex machine having these functions.

As shown in FIG. 1, the color printer 1 is comprised of an upper main body 1A (apparatus main body) housing various units and parts for image formation and a lower main body 1B arranged below this upper main body 1A and housing liquid developer circulation devices LY, LM, LC and LB for respective colors. Here, pipes connecting the upper and lower main bodies 1A, 1B are not shown.

As shown in FIG. 2, the upper main body 1A includes a tandem image forming station 2 for forming a toner image based on image data, a sheet storage unit 3 for storing sheets, a secondary transfer unit 4 for transferring a toner image formed by the image forming station 2 to a sheet, a fixing unit 5 for fixing the transferred toner image to the sheet, a sheet discharging unit 6 for discharging the sheet finished with a fixing process and a sheet conveying unit 7 for conveying the sheet from the sheet storage unit 3 to the sheet discharging unit 6.

The image forming station 2 includes an intermediate transfer belt 21, a cleaner 22 for the intermediate transfer belt 21 and image forming units FY, FM, FC and FB corresponding to respective colors of yellow (Y), magenta (M), cyan (C) and black (Bk).

The intermediate transfer belt 21 is an endless, i.e. looped belt-like member having a conductive property and a width larger than largest sheets in a direction orthogonal to a conveying direction of sheets, and is driven and rotated in a clockwise direction in FIGS. 1 and 2. A surface of the intermediate transfer belt 21 facing outward during rotation and an opposite surface thereof are respectively called an outer surface and an inner surface below.

The four image forming units FY, FM, FC and FB are arranged side by side near the intermediate transfer belt 21 and between the cleaner 22 for the intermediate transfer belt 21 and the secondary transfer unit 4. Note that an arrangement order of the respective image forming units FY, FM, FC and FB is not limited to this, but this arrangement is preferable in view of influence of mixing of the respective colors on a complete image.

Each of the image forming units FY, FM, FC and FB includes a photosensitive drum 10 (image carrying member), a charger 11, an LED exposure device 12, a developing device 14, a primary transfer roller 20, a cleaner 26, a charge neutralizer 13 and a carrier liquid removing roller 30. Out of the image forming units FY, FM, FC and FB, the image forming unit FB closest to the secondary transfer unit 4 does not include the carrier liquid removing roller 30, but the other construction thereof is identical.

The liquid developer circulation devices LY, LM, LC and LB are respectively provided in correspondence with the image forming units FY, FM, FC and FB to supply and collect the liquid developers of the respective colors. The liquid developer circulation devices LY, LM, LC and LB are described in detail later.

The photosensitive drum 10 is a cylindrical member and can carry a toner image containing charged toner (positively charged in this embodiment) on its surface. The photosensitive drum 10 is a member rotatable counterclockwise in FIGS. 1 and 2. The charger 11 is a device capable of uniformly charging the surface of the photosensitive drum 10. The exposure device 12 includes a light source such as an LED and irradiates the uniformly charged surface of the photosensitive drum 10 with light based on image data input from an external apparatus. In this way, an electrostatic latent image is formed on the surface of the photosensitive drum 10.

The developing device 14 causes toner to adhere to an electrostatic latent image by holding a liquid developer, in which the toner (dispersoid) as a solid content is dispersed in a dielectric liquid carrier (dispersion medium), such that the liquid developer faces the electrostatic latent image on the surface of the photosensitive drum 10. In this way, the electrostatic latent image is developed into a toner image. The developing device 14 is described in detail later.

The primary transfer roller 20 is arranged at the inner side of the intermediate transfer belt 21 to face the photosensitive drum 10. A voltage having a polarity (negative polarity in this embodiment) opposite to the toner in the toner image is applied to the primary transfer roller 20 from an unillustrated power supply. In other words, the primary transfer roller 20 applies a voltage having a polarity opposite to the toner to the intermediate transfer belt 21 at a position in contact with the intermediate transfer belt 21. Since the intermediate transfer belt 21 has a conductive property, the toner is attracted to the outer side of the intermediate transfer belt 21 and its surrounding by this voltage application. The intermediate transfer belt 21 functions as an image carrying member for bearing a toner image and conveying it to a sheet.

The cleaner 26 is a device for cleaning the liquid developer remaining without being transferred from the photosensitive drum 10 to the intermediate transfer belt 21 and includes a cleaning blade 262 (FIG. 5) for scraping off the remaining liquid developer on the surface of the photosensitive drum 10 and a remaining developer conveyor screw 261 (FIG. 5) for conveying the remaining developer scraped off by the cleaning blade 262 to the outside of the cleaner 26.

The cleaning blade 262 is a plate-like member extending in a rotation axis direction of the photosensitive drum 10. The cleaning blade 262 has an end portion thereof held in sliding contact with the surface of the photosensitive drum 10 to scrape off the liquid developer remaining on the photosensitive drum 10 as the photosensitive drum 10 rotates.

The charge neutralizer 13 includes a light source for charge neutralization and electrically neutralizes the surface of the photosensitive drum 10 by light from the light source in preparation for image formation by a next rotation after the liquid developer is removed by the cleaning blade 262.

The carrier liquid removing roller 30 is a substantially cylindrical member rotatable in the same direction as the photosensitive drum 10 about an axis of rotation parallel with an axis of rotation of the photosensitive drum 10. The carrier liquid removing roller 30 is arranged closer to the secondary transfer unit 4 than a contact position of the photosensitive drum 10 and the intermediate transfer belt 21 and removes the carrier liquid from the outer surface of the intermediate transfer belt 21.

The sheet storage unit 3 is for storing sheets to have toner images fixed thereto and arranged in a lower part of the upper main body 1A. The sheet storage unit 3 includes a sheet cassette storing the sheets.

The secondary transfer unit 4 is for transferring a toner image formed on the intermediate transfer belt 21 to a sheet and includes a supporting roller 41 supporting the intermediate transfer belt 21 and a secondary transfer roller 42 arranged to face the supporting roller 41.

The fixing unit 5 is for fixing a toner image to a sheet and arranged above the secondary transfer unit 4. The fixing unit 5 includes a heating roller 43 and a pressure roller 44 arranged to face the heating roller 43.

The sheet discharging unit 6 is for discharging a sheet having a toner image fixed thereto in the fixing unit 5 and arranged in an upper part of the color printer 1. The sheet conveying unit 7 includes a plurality of conveyor roller pairs and conveys a sheet from the sheet storage unit 3 to the secondary transfer unit 4, the fixing unit 5 and the sheet discharging unit 6.

Figure 3:
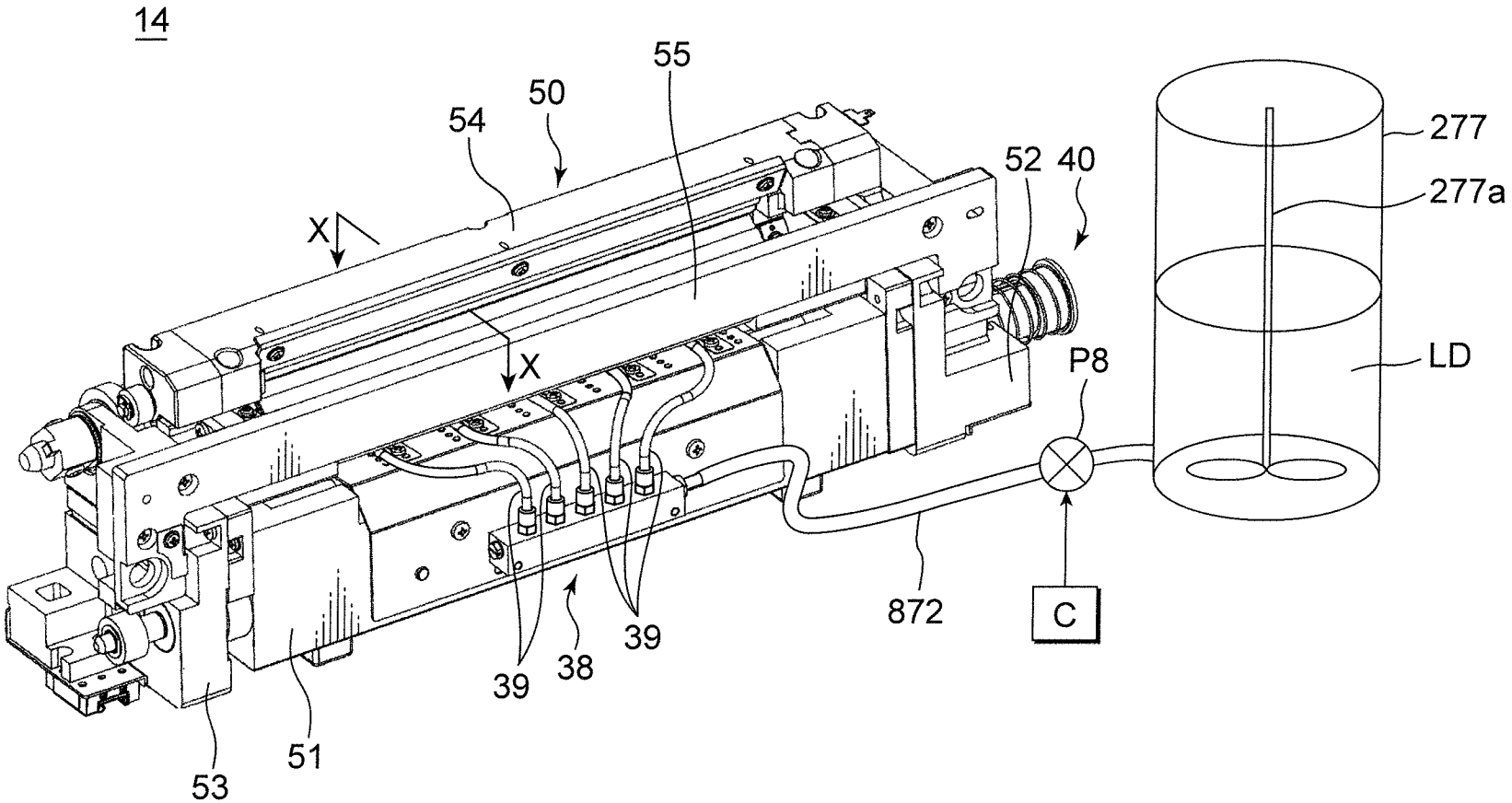
FIG. 3 is a perspective view showing an entire structure of a developing device in a longitudinal direction when the developing device according to the embodiment of the invention is viewed from one lateral side.
Figure 4:
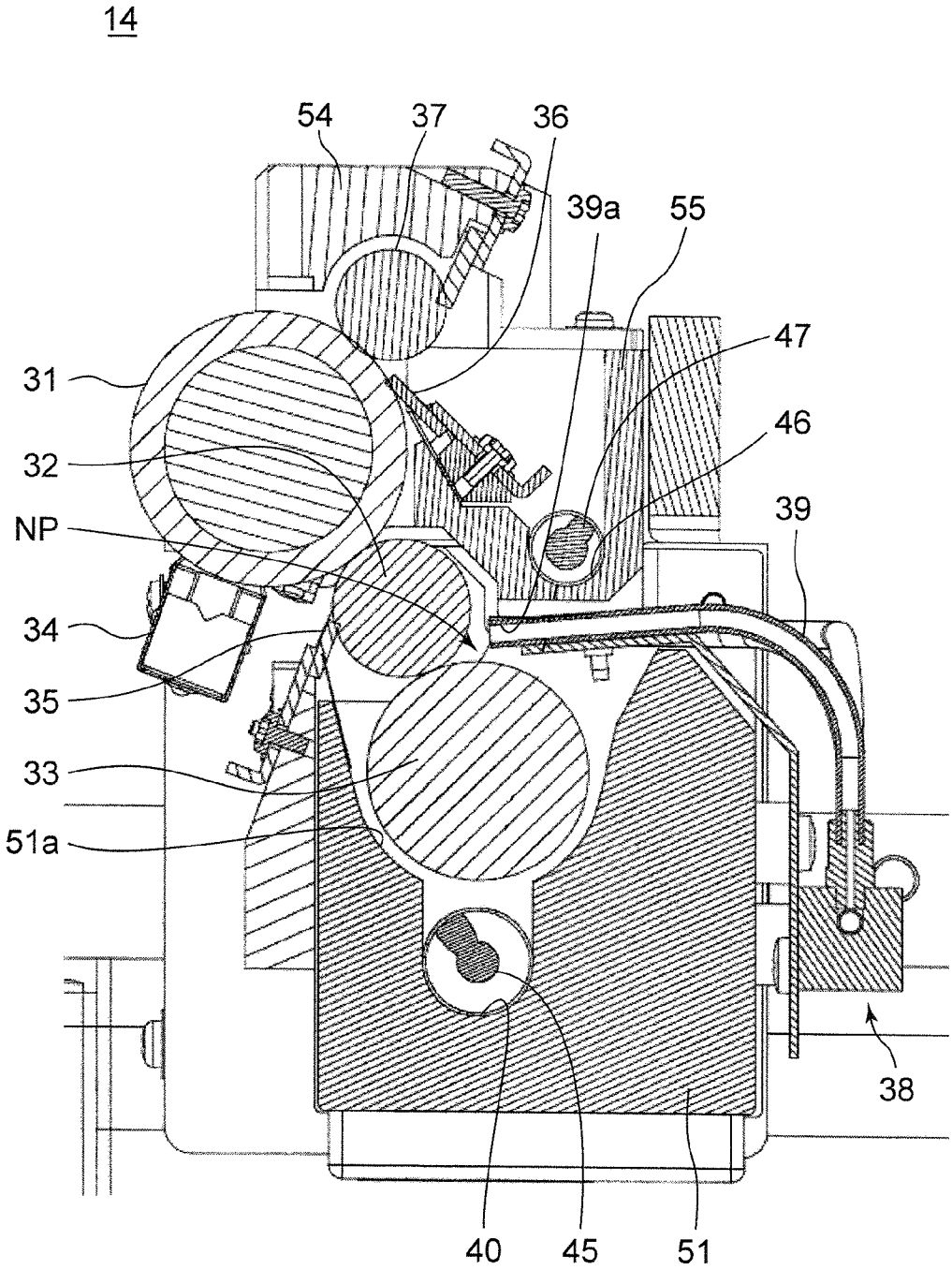
FIG. 4 is a sectional view cut along X-X of FIG. 3.

Next, the developing device 14 is described with reference to FIGS. 3 and 4. FIG. 3 is a perspective view showing an entire structure of the developing device in a longitudinal direction when the developing device according to the embodiment of the present invention is viewed from one lateral side. FIG. 4 is a sectional view cut along X-X of FIG. 3. The developing device 14 includes a developing container 50 housing constituent elements to be described later. The developing container 50 is a member shaped to extend in the longitudinal direction of the developing device 14, i.e. in the rotation axis direction of the photosensitive drum 10 and includes a main frame 51, an intermediate frame 55, an upper frame 54 and a pair of side frames 52, 53.

The main frame 51 is a container-like member extending in the longitudinal direction of the developing device 14 and has an open upper side as shown in FIG. 4. Groove portions 51*a*, 40 extending in the longitudinal direction of the developing device 14 are formed in two stages in the main frame 51. A nip forming roller 33 to be described later is rotatably arranged in the upper groove portion 51*a*. A first conveyor screw 45 is rotatably arranged in the lower groove portion 40. The upper and lower groove portions 51*a*, 40 communicate with each other.

The intermediate frame 55 is a container-like member extending in the longitudinal direction of the developing device 14, has an open upper side, and is so mounted on the main frame 51 from above as to cover a part of an opening of the main frame 51. A groove portion 46 extending in the longitudinal direction of the developing device 14 is formed at the bottom of the intermediate frame 55. A second conveyor screw 47 is rotatably arranged in the groove portion 46.

The upper frame 54 is a member extending in the longitudinal direction of the developing device 14 and so mounted on the intermediate frame 55 from above as to cover an opening of the intermediate frame 55. The main frame 51, the intermediate frame 55 and the upper frame 54 have substantially the same longitudinal dimension.

The pair of side frames 52, 53 cover the opposite side surfaces of the main frame 51 and those of the intermediate frame 55 at opposite longitudinal ends of the developing container 50. A first collection path 40 to be described later projects in the longitudinal direction of the developing device 14 from one side frame 52.

As shown in FIGS. 3 and 4, a liquid developer supplying device 38 for supplying the liquid developer to the developing device 14 is attached to an outer surface of the main frame 51 by screws or the like. The liquid developer supplying device 38 includes a plurality of branch supply pipes 39 (five in FIGS. 3 and 4) extending into the developing device 14. The liquid developer supplying device 38 is connected to a liquid developer reserve tank 277 (storage container) by a supply tube 872 and receives supply of a liquid developer LD from the liquid developer reserve tank 277 containing the liquid developer LD. An eighth pump P8 (conveying mechanism) is arranged in the supply tube 872. The eighth pump P8 is drive-controlled by a controller C to be described later. An agitating member 277*a* is provided in the liquid developer reserve tank 277, and the liquid developer LD is suitably agitated by the agitating member 277*a*.

The developing device 14 includes a developing roller 31, a supply roller 32, the nip forming roller 33, a restricting blade 35, a developing roller charger 34, a cleaning roller 37 and a cleaning blade 36 in the developing container 50 as shown in FIG. 4.

The nip forming roller 33 is a roller rotatably arranged in the upper groove portion 51*a* of the main frame 51 as described above. The supply roller 32 is a roller extending in a rotation axis direction of the nip forming roller 33 at a position obliquely above the nip forming roller 33. The nip forming roller 33 is arranged in contact with the supply roller 32. Thus, a supply nip portion NP is formed between the nip forming roller 33 and the supply roller 32. The plurality of branch supply pipes 39 of the above liquid developer supplying device 38 are arranged side by side along the rotation axis direction of the nip forming roller 33, and discharge ports 39*a* thereof are facing the supply nip portion NP. Accordingly, the liquid developer is discharged to the supply nip portion NP by the liquid developer supplying device 38. In FIG. 4, the nip forming roller 33 is rotated in a counterclockwise direction and the supply roller 32 is rotated in a clockwise direction.

The liquid developer discharged from the discharge ports 39*a* to the supply nip portion NP passes the supply nip portion NP as the nip forming roller 33 and the supply roller 32 rotate after temporarily staying at the supply nip portion NP, and is conveyed upward while being held on the circumferential surface of the supply roller 32. Grooves for holding the liquid developer are formed in the circumferential surface of the supply roller 32.

The restricting blade 35 is made of, for example, urethane rubber and the leading end thereof is pressed in contact with the circumferential surface of the supply roller 32. By this press-contact state, the restricting blade 35 restricts an amount of the liquid developer on the circumferential surface of the supply roller 32 to a predetermined amount. Excess liquid developer scraped off by the restricting blade 35 naturally falls down to be received by the upper groove portion 51*a* and then by the lower groove portion 40. The lower groove portion 40 forms a first collection path for collecting the liquid developer scrapped off by the restricting blade 35, and the liquid developer is conveyed to a liquid developer collecting container 70 (FIG. 5) by the rotation of the first conveyor screw 45.

The developing roller 31 is arranged in contact with the supply roller 32 in an opening formed between the main frame 51, the intermediate frame 55 and the upper frame 54. The developing roller 31 extends in parallel with the nip forming roller 33 and the supply roller 32 and is rotated in a counterclockwise direction in FIG. 4. Accordingly, at a nip portion where the developing roller 31 and the supply roller 32 are in contact, the circumferential surface of the developing roller 31 moves in a direction opposite to a moving direction of the circumferential surface of the supply roller 32. Thus, the liquid developer held on the circumferential surface of the supply roller 32 is transferred to the circumferential surface of the developing roller 31. Since the thickness of the liquid developer layer on the supply roller 32 is restricted to a predetermined value, that of the liquid developer layer formed on the circumferential surface of the developing roller 31 is also kept at a predetermined value.

The developing roller charger 34 causes the toner in the liquid developer layer carried on the developing roller 31 to move to a circumferential surface side of the developing roller 31 by giving a charge potential having the same polarity as a charged polarity of the toner, thereby fulfilling a function of improving development efficiency. The developing roller charger 34 is disposed to face the circumferential surface of the developing roller 31 at a side downstream of the nip portion between the developing roller 31 and the supply roller 32 and upstream of a nip portion between the developing roller 31 and the photosensitive drum 10 in a rotating direction of the developing roller 31.

The developing roller 31 is in contact with the photosensitive drum 10 to form the nip portion between itself and the photosensitive drum 10. The toner is transferred onto the circumferential surface of the photosensitive drum 10 to develop an electrostatic latent image due to a potential difference between a potential of the electrostatic latent image on the circumferential surface of the photosensitive drum 10 and a developing bias applied to the developing roller 31. In this way, a toner image is formed on the circumferential surface of the photosensitive drum 10.

The cleaning roller 37 is arranged downstream of the photosensitive drum 10 in the rotating direction of the developing roller 31 and the circumferential surface thereof is in contact with that of the developing roller 31. Thus, the liquid developer remaining on the circumferential surface of the developing roller 31 is scraped off. The scraped-off liquid developer is received into the groove portion 46 formed in the intermediate frame 55.

The cleaning blade 36 is arranged downstream of the cleaning roller 37 in the rotating direction of the developing roller 31, and the leading end thereof is in contact with the circumferential surface of the developing roller 31. Thus, the liquid developer remaining on the circumferential surface of the developing roller 31 that was not scraped off by the cleaning roller 31 is further scraped off. The scraped-off liquid developer flows down along a surface of the cleaning blade 36 to be received into the groove portion 46 formed in the intermediate frame 55. The groove portion 46 is formed as a second collection path, and the liquid developer in the second collection path 46 is introduced to a joint path (FIG. 5) communicating with the second collection path 46 and the first collection path 40 and then conveyed to the liquid developer collecting container 70 via the first collection path 40 by the rotation of the second conveyor screw 47.

Figure 5:
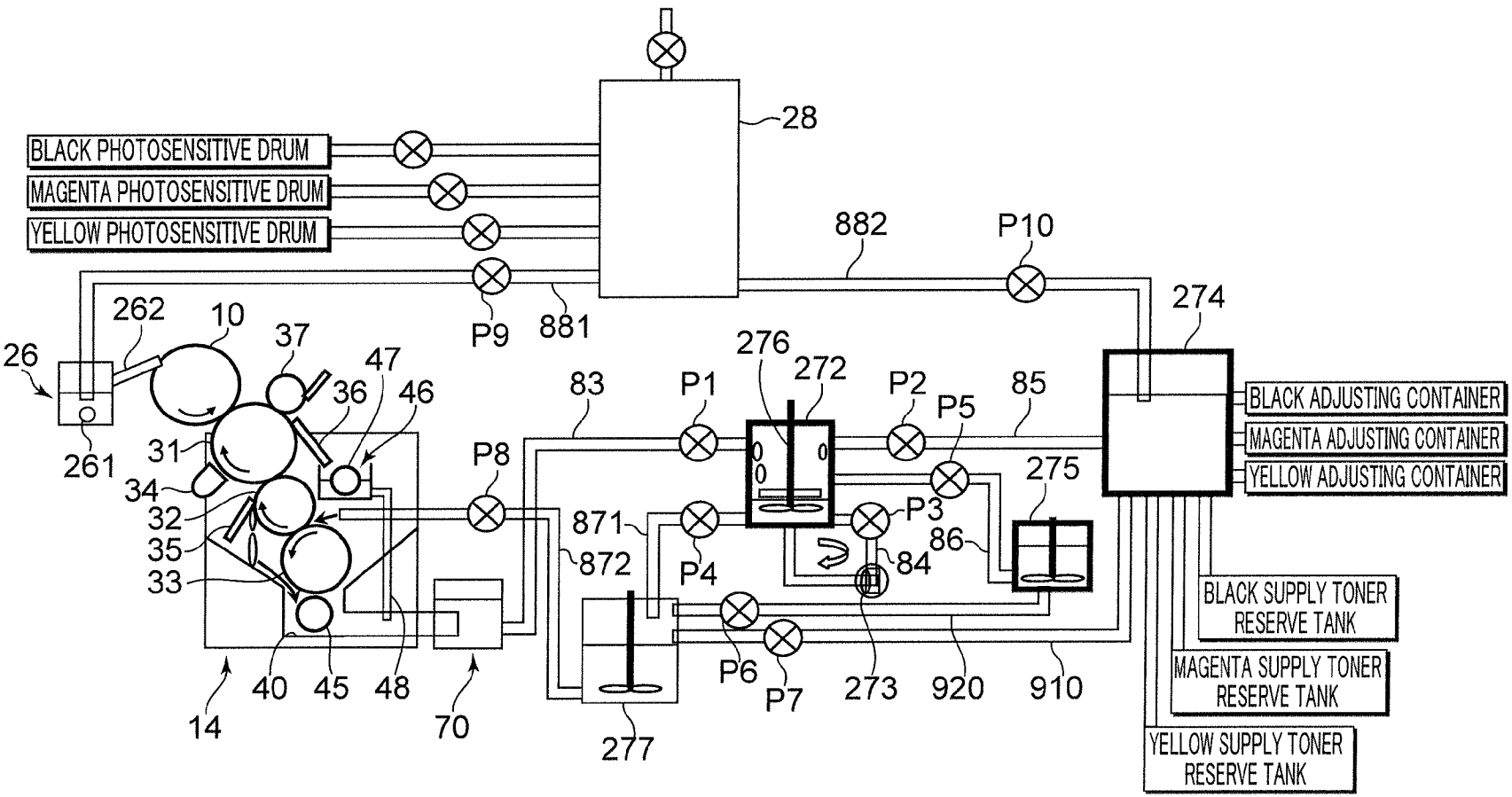
FIG. 5 is a schematic construction diagram showing a circulation system of liquid developers according to the embodiment of the invention.

Next, with reference to FIG. 5, a liquid developer circulation system is described which supplies the liquid developer to the developing device 14 and reutilizes the liquid developer collected from the developing device 14. FIG. 5 is a schematic construction diagram of one liquid developer circulation device LC according to the embodiment of the present invention showing the liquid developer circulation system. The other liquid developer circulation devices LY, LM and LB are identically constructed. The liquid developer circulation device LC is for supplying the liquid developer to the developing device 14 and utilizing the liquid developer collected into the liquid developer collecting container 70 via the first and second collection paths 40, 46.

The liquid developer circulation device LC includes the liquid developer collecting container 70, a developer adjusting container 272, a carrier tank 274, a toner tank 275, the developer reserve tank 277, a liquid developer separator 28 and a plurality of pumps P1 to P10.

The liquid developer collecting container 70 is connected to the developer adjusting container 272 via a first pipe 83. A first pump P1 is arranged in the first pipe 83, and the liquid developer collected into the liquid developer collecting container 70 is fed to the developer adjusting container 272 by driving the first pump P1.

The developer adjusting container 272 is for adjusting a toner density in a proper range by adding a developer having a higher toner density than the developer used in the developing device or a carrier liquid to the collected liquid developer. The liquid developer having the toner density adjusted is resupplied to the developing device 14.

A solid content density detector 273 is for detecting the density of the toner of the liquid developer in the developer adjusting container 272. The solid content density detector 273 is connected to an annular second pipe 84 connected to the developer adjusting container 272. A third pump P3 is mounted in the second pipe 84. The liquid developer in the developer adjusting container 272 is introduced to the solid content density detector 273 from an entrance end of the second pipe 84 and, then, returned to the developer adjusting container 272 from an exit end of the second pipe 84 by driving the third pump P3.

The carrier tank 274 is a tank containing the carrier liquid. When the density of the toner in the developer adjusting container 272 is determined to be higher than the proper range by the solid content density detector 273, the carrier liquid is supplied from the carrier tank 274 into the developer adjusting container 272 to reduce the toner density of the liquid developer in the developer adjusting container 272. The carrier tank 274 and the developer adjusting container 272 are connected by a third pipe 85, and a second pump P2 is arranged in the third pipe 85. The carrier liquid is supplied from the carrier tank 274 to the developer adjusting container 272 by driving the second pump P2.

The toner tank 275 is a tank containing the liquid developer having a higher toner density than the developer used in the developing device 14. When the density of the toner in the developer adjusting container 272 is determined to be lower than the proper range by the solid content density detector 273, the liquid developer having a higher toner density is supplied from the toner tank 275 into the developer adjusting container 272 to increase the toner density of the liquid developer in the developer adjusting container 272. The toner tank 275 and the developer adjusting container 272 are connected by a fourth pipe 86, and a fifth pump P5 is arranged in the fourth pipe 86. The liquid developer is supplied from the toner tank 275 to the developer adjusting container 272 by driving the fifth pump P5.

An agitator 276 for agitating the liquid developer is arranged in the developer adjusting container 272. The purpose of agitation by the agitator 276 is to uniformly mix the toner or carrier liquid introduced into the developer adjusting container 272 for density adjustment with the existing liquid developer in the developer adjusting container 272 and to re-disperse the toner that might aggregate in the liquid developer contained in the developer adjusting container 272. The agitator 276 includes a rotary shaft and an agitating blade attached to the leading end of this rotary shaft.

The developer reserve tank 277 is a tank containing the liquid developer to be supplied to the developing device 14 via the liquid developer supplying device 38 (FIG. 3). The developer reserve tank 277 is connected to the developer adjusting container 272 by a fifth pipe 871, and a fourth pump P4 is arranged in the fifth pipe 871. The liquid developer is supplied from the developer adjusting container 272 to the developer reserve tank 277 by driving the fourth pump P4.

The developer reserve tank 277 is connected to the carrier tank 274 by a first direct conduit 910 and to the toner tank 275 by a second direct conduit 920. A seventh pump P7 and a sixth pump P6 are respectively arranged in the first and second direct conduits 910, 920, so that the carrier and toner can be directly supplied to the developer reserve tank 277 from the respective tanks 274, 275. Carrier and toner supply systems from the first and second direct conduits 910, 920 are utilized in the case of quickly producing the liquid developer in accordance with a known mixing ratio such as at the time of starting to use the color printer 1 in which no liquid developer to be collected is present yet.

The developer reserve tank 277 is connected to the liquid developer supplying device 38 (FIG. 5) by the supply tube 872. The eighth pump P8 is arranged in the supply tube 872 as described above, and the liquid developer is supplied from the developer reserve tank 277 to the liquid developer supplying device 38 by driving the eighth pump P8.

Although not shown, liquid level detectors for detecting liquid levels in the liquid developer collecting container 70, the carrier tank 274, the toner tank 275 and the developer reserve tank 277 are provided at appropriate positions in these tanks.

The liquid developer separator 28 is for separating the remaining liquid developer collected from the photosensitive drum 10 by the cleaner 26 into the toner and carrier liquid and separately extracting the toner and carrier liquid. The cleaner 26 and the liquid developer separator 28 are connected by a sixth pipe 881 having a ninth pump P9 mounted therein. The liquid developer in the cleaner 26 is fed to the liquid developer separator 28 by driving the ninth pump P9.

A seventh pipe 882 having a tenth pump P10 mounted therein is provided between the liquid developer separator 28 and the carrier tank 274. The carrier liquid extracted in the liquid developer separator 28 is fed to the carrier tank 274 by driving the tenth pump P10. Note that the separated toner is discharged to the outside.

Developer adjusting containers for the respective colors of black, magenta and yellow and developer reserve tanks for the respective colors of black, magenta and yellow are connected to the carrier tank 274. Further, the photosensitive drums 10 for the respective colors of black, magenta and yellow are connected to the liquid developer separator 28 via the cleaners.

Figure 6:
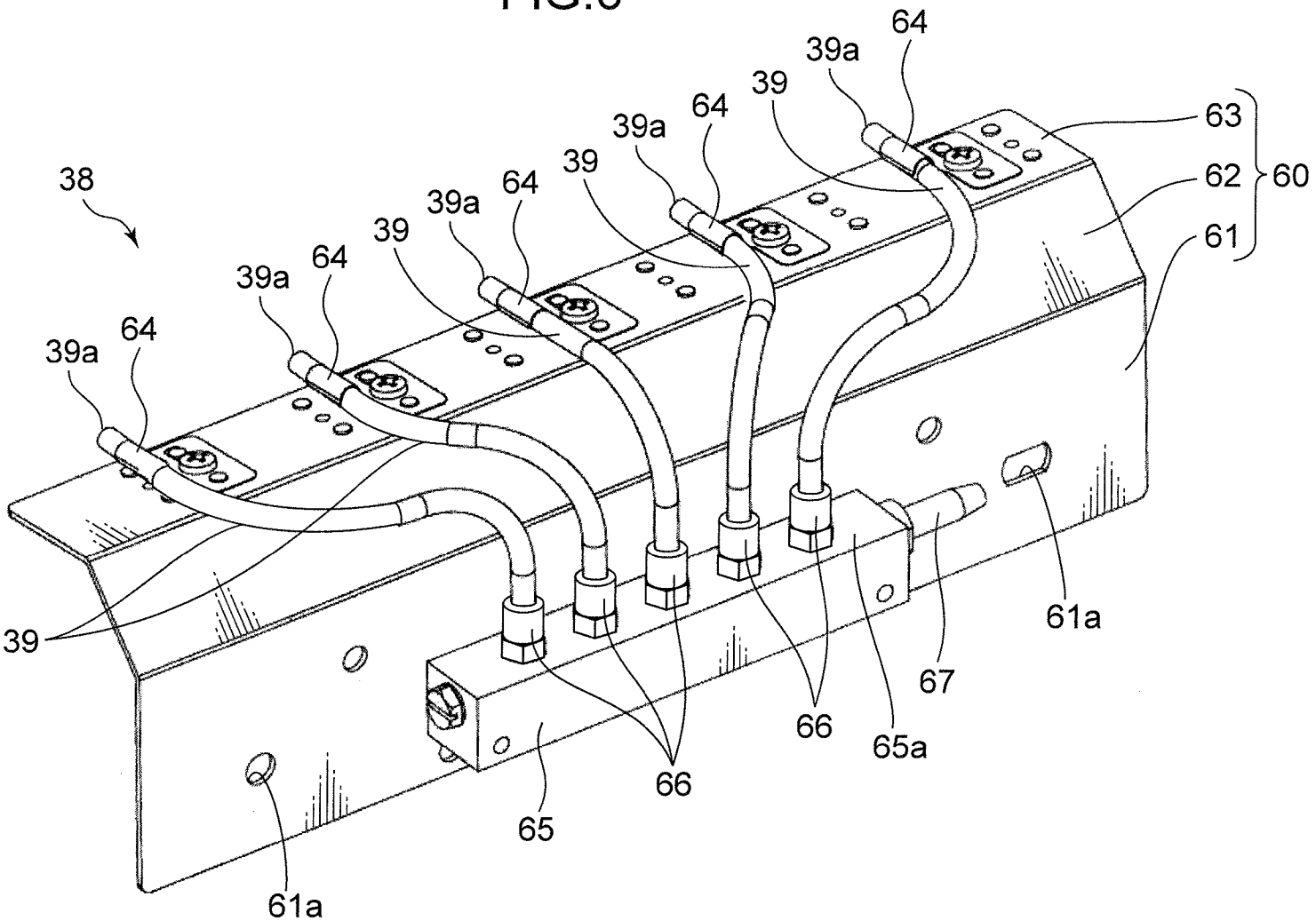
FIG. 6 is a perspective view of a liquid developer supplying device according to the embodiment of the invention showing a state where the liquid developer supplying device is detached from a main frame.
Figure 7:
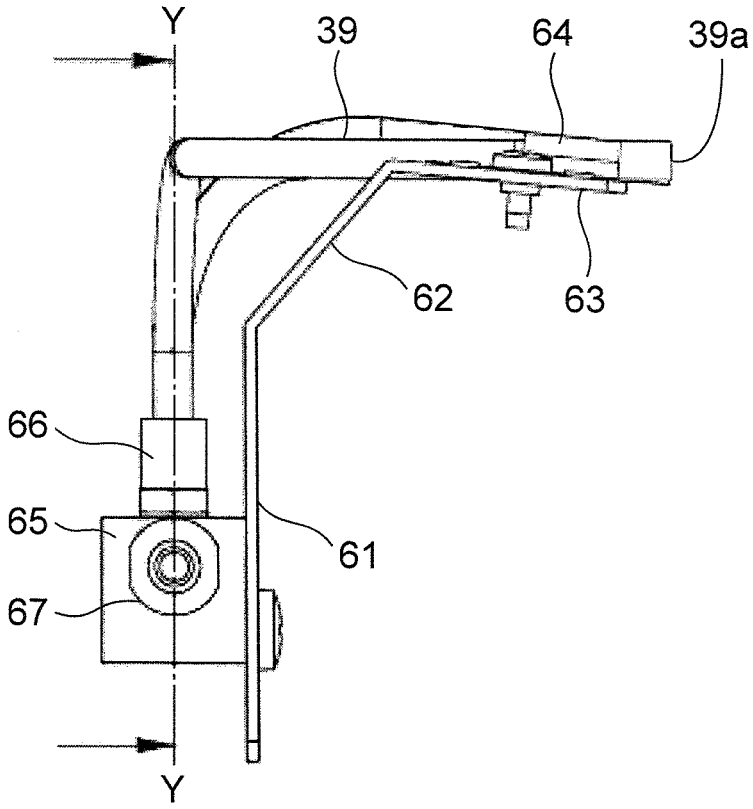
FIG. 7 is a side view of the liquid developer supplying device according to the embodiment of the invention.
Figure 8:
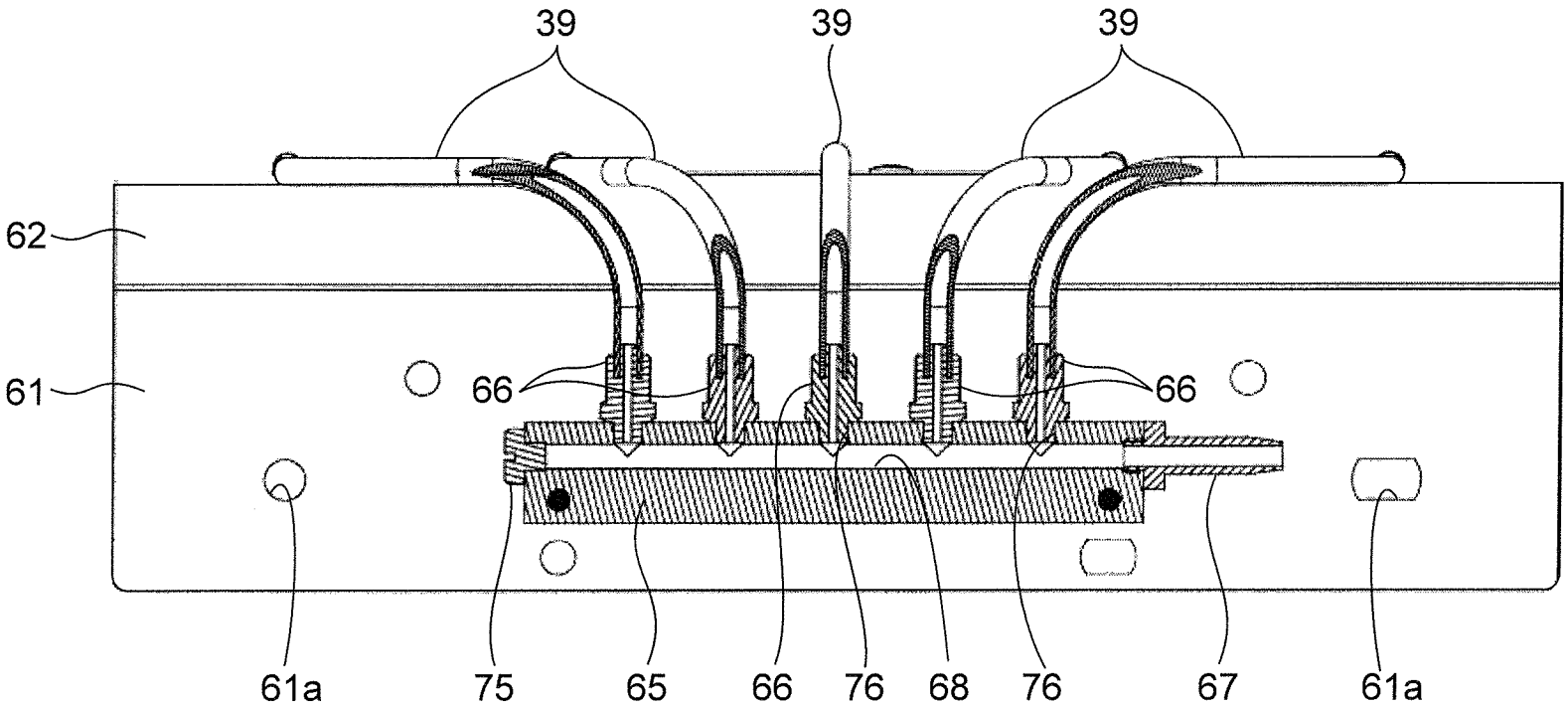
FIG. 8 is a front view in section of the liquid developer supplying device cut along Y-Y of FIG. 7.

Next, the liquid developer supplying device is described in detail with reference to FIGS. 6 to 8. FIG. 6 is a perspective view of the liquid developer supplying device according to the embodiment of the present invention in a state detached from the main frame. FIG. 7 is a side view of the liquid developer supplying device according to the embodiment of the present invention, and FIG. 8 is a front view in section of the liquid developer supplying device cut along Y-Y of FIG. 7.

The liquid developer supplying device 38 includes a frame member 60, a common flow path forming member 65, a plurality of connecting pipes 66 and a plurality of branch supply pipes 39.

The frame member 60 includes a flat portion 61 extending substantially in a vertical direction and in the longitudinal direction of the developing device 14, an intermediate portion 62 extending obliquely upward from the upper edge of the flat portion 61, and a top portion 63 extending substantially in a horizontal direction from the upper edge of the intermediate portion 62. The flat portion 61 is formed with a plurality of mount holes 61*a* used to fix the liquid developer supplying device 38 to the main frame 51 by screws or the like. Thus, the liquid developer supplying device 38 is detachably attached to the main frame 51 via the flat portion 61.

The common flow path forming member 65 is an elongated block-shaped member extending in the longitudinal direction of the developing device 14 and fixed to the flat portion 61. A single common flow path 68 extending in the longitudinal direction and the horizontal direction is formed in the common flow path forming member 65. One opening of the common flow path 68 is closed by a closure member 75. A nozzle member 67 is fitted into the other opening of the common flow path 68, and one end of the supply tube 872 is fitted to the nozzle member 67 as shown in FIG. 3.

The plurality of connecting pipes 66 are members fixed to an upper surface 65*a* of the common flow path forming member 65 while being spaced apart at predetermined intervals along the common flow path 68. Specifically, the upper surface 65*a* of the common flow path forming member 65 is formed with a plurality of through holes 76 arranged at predetermined intervals along the common flow path 68, and one end of the corresponding connecting pipe 66 is fitted into each of these through holes 76. Thus, the plurality of connecting pipes 66 and the common flow path 68 communicate with each other.

One end of each of the plurality of branch supply pipes 39 is fitted into the other end of the corresponding connecting pipe 65. Thus, the branch supply pipes 39 communicate with the connecting pipes 66 and consequently with the common flow path 68. The five branch supply pipes 39 extend along the flat portion 61, the intermediate portion 62 and the top portion 63 in such a manner that the other ends thereof are located at predetermined intervals in the longitudinal direction of the frame member 60 on the top portion 63 as shown in FIG. 6. Thus, in a state where the liquid developer supplying device 38 is attached to the main frame 51 of the developing device 14, the other ends of the plurality of branch supply pipes 39 are arranged side by side in the rotation axis direction of the nip forming roller 33, and the discharge ports 39*a* thereof face the supply nip portion NP. The predetermined interval is so set that the liquid developer is uniformly dispersed in the rotation axis direction on the circumferential surface of the nip forming roller 33 when the liquid developer is discharged to the circumferential surface of the nip forming roller 33 from the discharge ports 39*a*. This makes it easier to form a liquid developer layer with a uniform thickness on the circumferential surface of the developing roller 31. Since the other ends of the five branch supply pipes 39 are held on the top portion 63 extending substantially in the horizontal direction, they are located on a horizontal plane.

The plurality of branch supply pipes 39 are fixed to the top portion 63 by clasps 64. In this way, the discharge ports 39*a* of the respective branch supply pipes 39 are set to reliably face the supply nip portion NP.

The liquid developer supplying device 38 constructed as described above supplies the liquid developer to the supply nip portion NP as follows. Specifically, when the eighth pump P8 is driven, the liquid developer flows from the developer reserve tank 277 into the nozzle member 67 via the supply tube 872. The liquid developer then flows into the common flow path 68 and flows into the connecting pipes 66 when the common flow path 68 is filled with the liquid developer. Thereafter, at the time of a developing operation, the liquid developer passes the connecting pipes 66 to flow into the branch supply pipes 39 and is discharged to the supply nip portion NP from the discharge ports 39*a*. The liquid developer discharged to the supply nip portion NP is conveyed to the developing roller 31 by the supply roller 32 as described above. Note that, in this embodiment, the common flow path 68 of the common flow path forming member 65, flow paths of the connecting pipes 66 and those of the branch supply pipes 39 form a liquid developer flow path.

Figure 9:
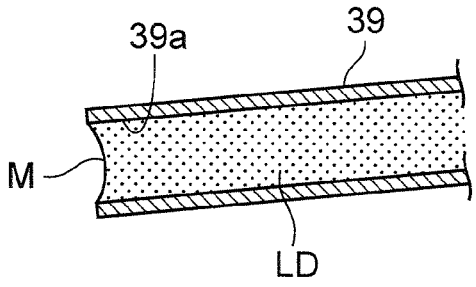
FIG. 9 is a diagram showing a meniscus state of the liquid developer at a discharge port of the liquid developer supplying device according to the embodiment of the invention.

In the liquid developer supplying device 38 constructed as described above, after the liquid developer is discharged from the discharge ports 39*a*, the liquid developer LD is kept in a meniscus state M in the discharge ports 39*a* as shown in FIG. 9. Although the liquid developer LD has a viscosity of about 50 to 200 mPa·s, surface tension of a meniscus is weak. Thus, the meniscus state of the liquid developer LD cannot be maintained due to an impact and/or vibration produced when the liquid developer supplying device 38 is detached from the main frame 51 of the developing device 14 for maintenance, whereby the liquid developer LD leaks out from the discharge ports 39*a*. If the liquid developer LD leaks out, the interior of the upper main body 1A of the image forming apparatus 1 is contaminated. Further, if the leaked liquid developer adheres to the hand of a maintenance operator, a maintenance operation is disrupted.

If the developing device 14 does not perform a developing operation for a long time, the toner as a solid content in the liquid developer precipitates and is accumulated particularly in the common flow path 68. Thus, when a new developing operation is performed, a supply amount of the toner discharged from the discharge ports 39*a* is reduced and/or a discharge failure occurs due to the clogging of the precipitated toner solid content in the connecting pipes 66 and the branch supply pipes 39. Due to such inconveniences, it becomes difficult to properly supply the liquid developer to the supply nip portion NP and, consequently, to form a liquid developer layer with a uniform thickness on the circumferential surface of the developing roller 31.

Accordingly, in this embodiment, in order to solve the above inconveniences, at least a part of the liquid developer already supplied to the liquid developer supplying device 38 is drained off from the liquid developer supplying device 38 by driving the eighth pump P8 beforehand when maintenance is performed or when the developing device 14 does not perform a developing operation for a long time.

Specifically, the eighth pump P8 is so constructed as to be able to not only feed the liquid developer LD from the developer reserve tank 277 to the liquid developer supplying device 38, but also feed the liquid developer already supplied to the liquid developer supplying device 38 back to the developer reserve tank 277. The eighth pump P8 is, for example, a tube pump and can pressurize the liquid developer to feed the liquid developer from the developer reserve tank 277 to the liquid developer supplying device 38 and suck the liquid developer present in the liquid developer flow path to feed the liquid developer from the liquid developer supplying device 38 back to the developer reserve tank 277. If a suction force is applied to the common flow path 68 by the eighth pump P8, the liquid developer can be caused to recede in all the branch supply pipes 39.

The eighth pump P8 is controlled by the controller C as described above. The controller C controls the eighth pump P8 to feed at least a part of the liquid developer present in the liquid developer flow path of the liquid developer supplying device 38 back to the developer reserve tank 277 when maintenance is performed or when the developing device 14 does not perform a developing operation for a long time, i.e. when no developing operation to form a toner image is performed by the developing device 14. Note that the controller C controls the eighth pump P8 to feed the liquid developer from the developer reserve tank 277 to the liquid developer supplying device 38 at the time of a developing operation to form a toner image.

Figure 10:
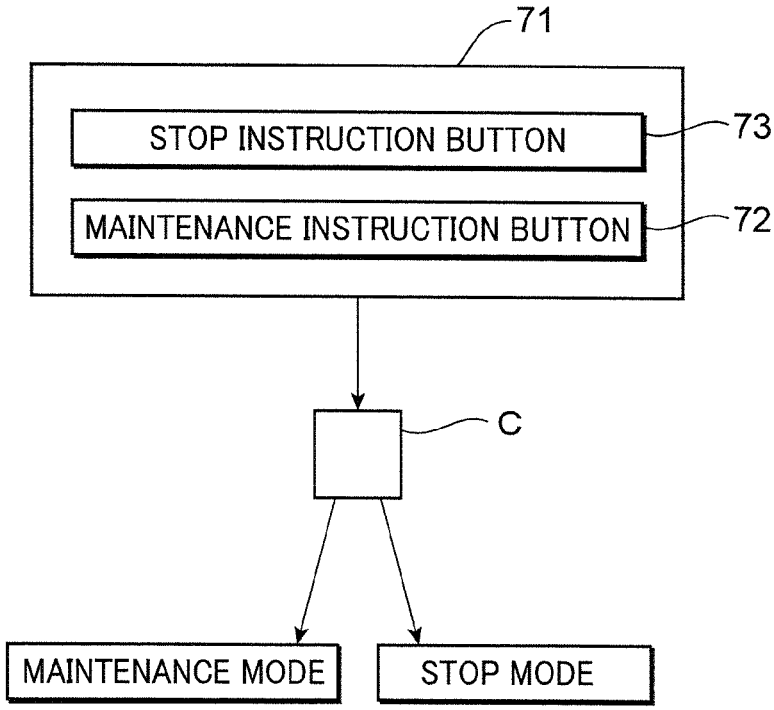
FIG. 10 is a block diagram of an operation unit provided in the image forming apparatus according to the embodiment of the invention.

An operation unit 71 is provided at a proper position of the upper main body 1A. The operation unit 71 includes a maintenance instruction button 72 and a stop instruction button 73 as shown in FIG. 10. The maintenance instruction button 72 is pressed by a maintenance operator to notify the controller C that a maintenance operation is to be performed (maintenance information). The stop instruction button 73 is pressed by a user to notify the controller C that the developing device 14 is to be stopped (stop information). The stop instruction button 73 is pressed by a user, for example, when a printing operation of the day is finished or when time to a next printing operation after the end of a certain printing operation is long (i.e. when the developing device 14 is not operated for such a period that the solid content of the liquid developer in the liquid developer flow path settles down). The stop instruction button 73 may be a power switch of the image forming apparatus 1. In this case, the controller C executes a stop mode to be described later as one end operation of the image forming apparatus 1.

Figure 11:
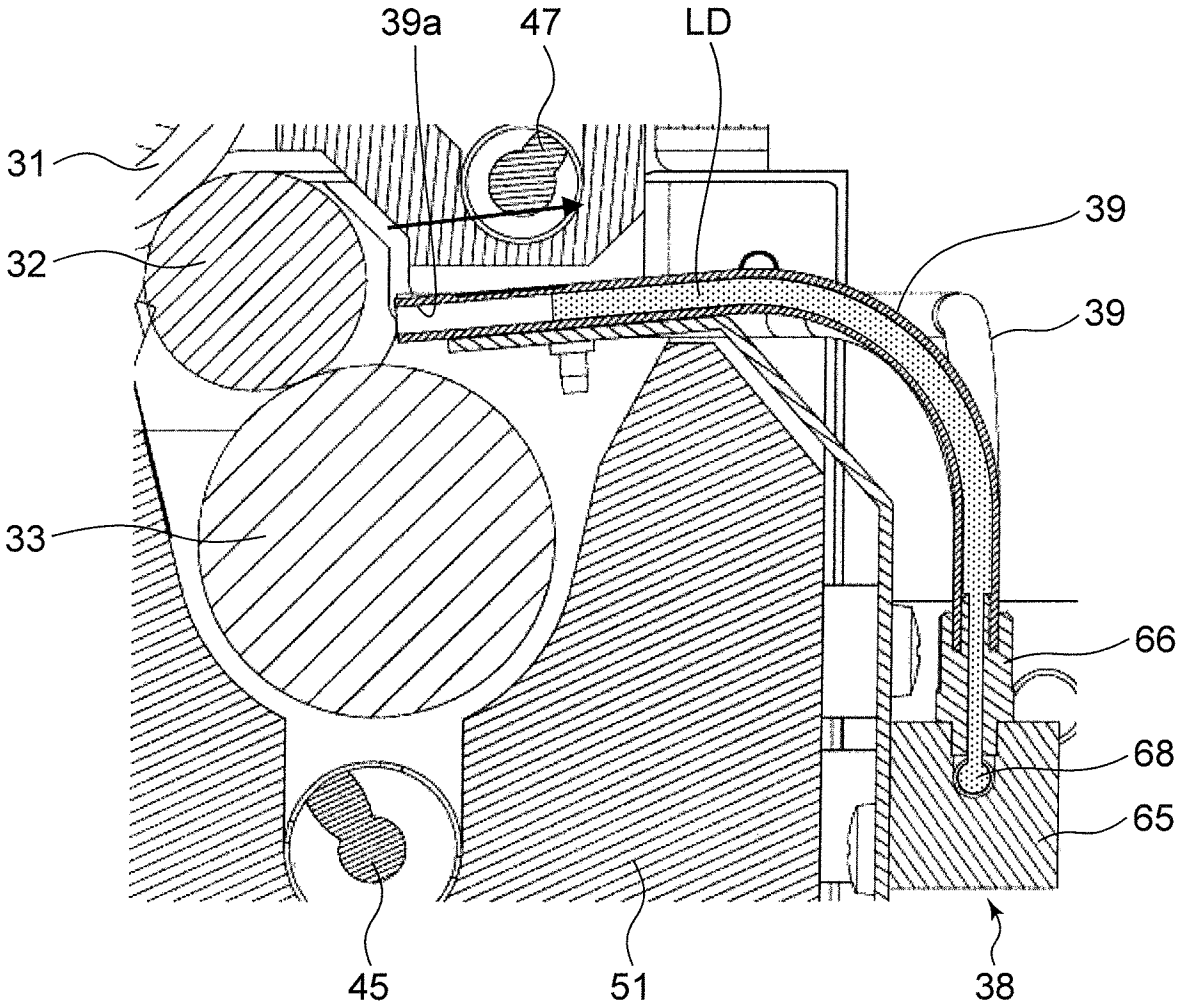
FIG. 11 is a diagram showing a fed-back state of the liquid developer when a maintenance mode is executed by a controller according to the embodiment of the invention.

The controller C executes a maintenance mode upon receiving the maintenance information. In the maintenance mode, the controller C controls the eighth pump P8 to feed (suck) a part of the liquid developer in the liquid developer supply path of the liquid developer supplying device 38, i.e. the common flow path 68, the connecting pipes 66 and the branch supply pipes 39 back to the developer reserve tank 277. Thus, the liquid developer LD present near the discharge ports 39*a* recedes from the discharge ports 39*a* as shown in FIG. 11.

In this way, it can be suppressed that the liquid developer drips from the discharge ports 39*a* due to an impact or vibration produced when the liquid developer supplying device 38 is detached from the developing device 14 for maintenance. As a result, the interior of the image forming apparatus 1 can be kept clean. Further, since there is no likelihood that the dripping liquid developer adheres to the maintenance operator, the maintenance operation can be smoothly performed.

On the other hand, the controller C executes the stop mode upon receiving the stop information. In the stop mode, the controller C controls the eighth pump P8 to feed substantially the entire amount of the liquid developer present in the liquid developer flow path back to the developer reserve tank 277. The entire amount of the liquid developer in the liquid developer flow path is collected into the developer reserve tank 277 via the supply tube 872.

Thus, it can be suppressed that, when the developing device 14 does not perform a developing operation for a long time, the solid content of the liquid developer settles down and is accumulated in the liquid developer flow path, particularly in the common flow path 68. Therefore, inconveniences such as a reduction in the discharge amount of the toner and a discharge failure can be avoided. As a result, it becomes possible to appropriately supply the liquid developer to the supply nip portion NP and consequently to form a liquid developer layer with a uniform thickness on the circumferential surface of the developing roller 31.

Note that the maintenance instruction button 72 and the stop instruction button 73 may be provided on different operation units 71 so as not to confuse the maintenance operator and the user. Further, the operation unit 71 may include a button for sending another piece of information to the controller C in addition to the maintenance instruction button 72 and the stop instruction button 73.

The controller C is so constructed as to be able to, at the time of a developing operation to form a toner image by the developing device 14, control the eighth pump P8 to feed the liquid developer from the developer reserve tank 277 to the liquid developer flow path and control the agitating member 277*a* to agitate the liquid developer in the developer reserve tank 277 before a toner image forming operation is performed.

The controller C first controls the agitating member 277*a* to agitate the liquid developer in the developer reserve tank 277 when the developing device 14 starts a start-up operation to form a new toner image or when the power switch of the image forming apparatus 1 is turned on. Thus, the solid content can be uniformly dispersed in the liquid developer by mixing the liquid developer collected from the liquid developer flow path when the developing device 14 was stopped last time and the liquid developer contained beforehand through the agitation by the agitating member 277*a*. Thus, a solid content density can be made uniform in the liquid developer.

The controller C controls the eighth pump P8 to feed the liquid developer with a uniform solid content density from the developer reserve tank 277 to the liquid developer flow path after controlling the agitating member 277*a* to agitate the liquid developer for a predetermined time to such an extent that the solid content density becomes uniform in the liquid developer. Thus, a toner image with a high image quality can be formed.

Since the eighth pump P8 is a pump capable of pressurizing and sucking the liquid developer relative to the liquid developer flow path of the liquid developer supplying device 38, e.g. a tube pump, the liquid developer can be fed and fed back by a simple construction.

This application is based on Japanese Patent application serial No. 2010-034401 filed in Japan Patent Office on Feb. 19, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an image carrying member on which a toner image is to be formed;

a developing device including a developing roller for supplying a liquid developer containing a solid content to the image carrying member to form the toner image on the image carrying member, a supply roller for supplying the liquid developer to the developing roller, a nip forming roller, disposed so that a supply nip portion is formed between the supply roller and nip forming roller, the liquid developer being discharged to the supply nip portion;

a liquid developer supplying device including a liquid developer flow path in which the liquid developer flows and supplying the liquid developer to the developing device through a discharge port of the liquid developer flow path, the discharge port facing the supply nip portion;

a storage container storing the liquid developer;

a conveying mechanism capable of feeding the liquid developer from the storage container to the liquid developer flow path and feeding the liquid developer in the liquid developer flow path back to the storage container; and a controller controlling the conveying mechanism;

wherein at the time of non-developing operation in which a toner image forming operation is not performed by the developing device, the controller controls the conveying mechanism to feed at least a part of the liquid developer present in the liquid developer flow path back to the storage container.

2. An image forming apparatus according to claim 1, further comprising an operation unit giving to the controller information including maintenance information for notifying a maintenance operation, wherein:

the liquid developer supplying device is detachably attached to the developing device; and when receiving the maintenance information, the controller controls the conveying mechanism to feed a part of the liquid developer present in the liquid developer flow path back to the storage container, causing the liquid developer present near the discharge port to recede from the discharge port.

3. An image forming apparatus according to claim 1, further comprising an operation unit giving to the controller information including stop information for notifying that the developing device is to be stopped, wherein:

when receiving the stop information, the controller controls the conveying mechanism to feed substantially the entire amount of the liquid developer present in the liquid developer flow path back to the storage container.

4. An image forming apparatus according to claim 1, wherein:

the conveying mechanism is a pump capable of pressurizing the liquid developer to feed the liquid developer from the storage container to the liquid developer flow path and sucking the liquid developer to feed the liquid developer from the liquid developer flow path back to the storage container.

5. An image forming apparatus according to claim 4, wherein:

the liquid developer supplying device includes a common flow path forming member having a single common flow path communicating with the storage container, and a plurality of branch supply pipes each including the discharge port and communicating with the common flow path;

the common flow path and the branch supply pipes form the liquid developer flow path; and the pump is connected to the common flow path forming member.

6. An image forming apparatus according to claim 1, wherein:

the developing device includes a developer carrying member for supplying the liquid developer to the image carrying member;

the liquid developer supplying device includes a common flow path forming member having a single common flow path communicating with the storage container, and a plurality of branch supply pipes each including the discharge port and communicating with the common flow path;

the common flow path and the branch supply pipes form the liquid developer flow path; and the discharge ports of the plurality of branch supply pipes are located at predetermined intervals in a rotation axis direction of the developer carrying member.

7. An image forming apparatus according to claim 1, wherein:

the storage container includes an agitating member agitating the stored liquid developer; and at the time of a developing operation to form a toner image by the developing device, the controller is so constructed as to be able to control the conveying mechanism to feed the liquid developer from the storage container to the liquid developer flow path and control the agitating member to agitate the liquid developer in the storage container before the toner image forming operation is performed.

8. An image forming apparatus according to claim 1, wherein:

the liquid developer supplying device includes a supply pipe in which the liquid developer flows, and a plate portion supporting the supply pipe;

the supply pipe includes one end having the discharge port and the other end communicating with the storage container; and the plate portion holds the one end on a horizontal plane.

9. An image forming apparatus according to claim 1, wherein:

the liquid developer supplying device includes a common flow path forming member having a single common flow path communicating with the storage container, and a plurality of branch supply pipes each including the discharge port and communicating with the common flow path;

the common flow path and the branch supply pipes form the liquid developer flow path; and the common flow path extends substantially in a horizontal direction.

10. An image forming apparatus according to claim 1, wherein:

the controller feeds at least a part of the liquid developer back to prevent the liquid developer from forming a meniscus at the discharge port.

* * * * *